US012714238B2

(12) United States Patent
Peterson et al.

(10) Patent No.: US 12,714,238 B2
(45) Date of Patent: Aug. 25, 2026

(54) NESTED FOAM LAYERS IN BEDDING OR SEATING PRODUCT

(71) Applicant: L&P Property Management Company, South Gate, CA (US)

(72) Inventors: Bruce Peterson, Austin, TX (US); Heidi Stojanovic, Fort Smith, AR (US)

(73) Assignee: L&P Property Management Company, Carthage, MO (US)

( * ) Notice: Subject to any disclaimer, the term of this patent is extended or adjusted under 35 U.S.C. 154(b) by 62 days.

(21) Appl. No.: 18/778,269

(22) Filed: Jul. 19, 2024

(65) Prior Publication Data

US 2026/0020687 A1 Jan. 22, 2026

(51) Int. Cl.
*A47C 27/05* (2006.01)
*A47C 27/06* (2006.01)
*A47C 27/14* (2006.01)

(52) U.S. Cl.
CPC ..... *A47C 27/056* (2013.01); *A47C 27/064* (2013.01); *A47C 27/144* (2013.01)

(58) Field of Classification Search
CPC .... A47C 27/056; A47C 27/064; A47C 27/144
USPC ..... 5/720
See application file for complete search history.

(56) References Cited

U.S. PATENT DOCUMENTS 2,584,313 A * 2/1952 Woodman ..... A43D 25/10 428/166
2,902,091 A 9/1959 Dahle
3,026,544 A * 3/1962 Persicke ..... A47C 27/144 428/101
3,197,357 A 7/1965 Schulpen
3,222,697 A * 12/1965 Scheermesser ..... A47C 27/15 5/636
3,319,274 A * 5/1967 Upton ..... A47C 27/144 5/722
3,885,258 A * 5/1975 Regan ..... A47C 27/16 297/452.37
4,053,957 A * 10/1977 Regan ..... A47C 23/00 5/727
4,207,636 A 6/1980 Ceriani
4,566,926 A 1/1986 Stumpf
4,567,086 A * 1/1986 Fukuda ..... H01M 8/2483 429/513
4,673,452 A 6/1987 Awdhan
(Continued)

FOREIGN PATENT DOCUMENTS

DE 10339555 A1 6/2005
JP 2024085807 A 6/2024
(Continued)

*Primary Examiner* — Justin C Mikowski
*Assistant Examiner* — Luke Hall
(74) *Attorney, Agent, or Firm* — Wood Herron & Evans LLP

(57) ABSTRACT

A bedding or seating product comprises a first layer of foam having a patterned first surface nested with a patterned surface of a second layer of foam to create a transition zone between the first and second layers of foam. At least one of the layers of foam may have additives therein. Each patterned surface comprises rounded peaks and rounded valleys. Air channels may be created in the transition zone if the rounded peaks and rounded valleys of one layer of foam are a different height than the rounded peaks and rounded valleys of the other layer of foam.

24 Claims, 20 Drawing Sheets

(56) References Cited

U.S. PATENT DOCUMENTS

| | | | | |
|---|---|---|---|---|
| 4,748,922 | A | 6/1988 | Bierbaum et al. | |
| 4,879,776 | A * | 11/1989 | Farley | A47C 27/146 5/736 |
| 4,980,936 | A * | 1/1991 | Frickland | A47C 27/146 5/420 |
| 5,367,727 | A * | 11/1994 | Dyer, Jr. | A47C 27/085 5/678 |
| 5,868,383 | A | 2/1999 | Codos | |
| 6,115,861 | A * | 9/2000 | Reeder | A61G 7/05776 5/722 |
| 7,426,810 | B2 | 9/2008 | Takahashi et al. | |
| 7,574,762 | B2 * | 8/2009 | Baker | A47C 27/001 5/721 |
| 7,850,153 | B2 * | 12/2010 | Bock | A47C 27/064 5/247 |
| 8,261,387 | B2 | 9/2012 | Lipman et al. | |
| 10,758,058 | B2 * | 9/2020 | Oh | A47C 27/148 |
| 11,229,299 | B1 * | 1/2022 | Peterson | A47C 27/056 |
| 2003/0221261 | A1 * | 12/2003 | Torbet | A47C 27/082 5/709 |
| 2003/0221262 | A1 * | 12/2003 | Torbet | A47C 27/082 5/713 |
| 2006/0260059 | A1 * | 11/2006 | Apperson | A47C 27/144 5/691 |
| 2010/0237082 | A1 * | 9/2010 | Fernandez | A47C 27/16 428/152 |
| 2012/0189809 | A1 | 7/2012 | Henson | |
| 2014/0208517 | A1 * | 7/2014 | Gross | A47C 27/15 5/691 |
| 2014/0373281 | A1 * | 12/2014 | Mossbeck | A47C 27/053 5/718 |
| 2017/0251824 | A1 * | 9/2017 | Pearce | B65B 63/026 |
| 2021/0161301 | A1 * | 6/2021 | Smiderle | A47C 27/056 |
| 2021/0186228 | A1 * | 6/2021 | Martens | A47C 27/15 |
| 2022/0061546 | A1 * | 3/2022 | Gladney | A47C 27/064 |
| 2022/0338641 | A1 * | 10/2022 | Smiderle | A43B 13/12 |
| 2023/0067095 | A1 | 3/2023 | Teller | |

FOREIGN PATENT DOCUMENTS

| | | | |
|---|---|---|---|
| WO | 2007147472 | A2 | 12/2007 |
| WO | 2019241675 | A1 | 12/2019 |

* cited by examiner

NESTED FOAM LAYERS IN BEDDING OR SEATING PRODUCT

FIELD OF THE INVENTION

This invention relates generally to bedding and seating products and, more particularly, to bedding and seating products having multiple nested foam layers.

BACKGROUND OF THE INVENTION

Mattress spring core construction over the years has been a continuously improving art with advancements in materials and machine technology. A well-known form of spring core construction is known as a Marshall spring construction wherein metal coil springs are encapsulated in individual pockets of fabric and formed as elongate or continuous strings of pocketed coil springs. These strings of coil springs are commonly manufactured by folding an elongate piece of fabric in half lengthwise to form two plies of fabric and ultrasonically welding transverse and longitudinal seams to join the plies of fabric to define pockets within which the springs are enveloped.

Once strings of pocketed springs are constructed, they are assembled to form a pocketed spring core for a mattress, cushion or the like by a variety of methods. For example, multiple or continuous strings may be arranged in a row pattern corresponding to the desired size and shape of a mattress or the like, and adjacent rows of strings may be interconnected by a variety of methods. The result is a unitary assembly of pocketed coil springs.

Conventional mattresses incorporating pocketed spring assemblies have multiple layers of foam on one or both sides of the pocketed spring core. The foam layers are commonly glued together. The glue or adhesive is costly and may inhibit airflow through the product. The present invention eliminates the undesirable need to glue the foam layers together, thus reducing manufacturing costs and improving airflow.

Therefore, there remains a need to combine multiple technologies to reduce the manufacturing costs of a bedding or seating product having nested pieces of foam.

There is further a need for a mattress having improved airflow due to an absence of adhesive.

There is further a need for a mattress having air channels extending between foam pieces.

SUMMARY OF THE INVENTION

In one aspect, a bedding or seating product is provided. The product comprises a pocketed spring core comprising a plurality of parallel strings of pocketed springs, each string being joined to at least one adjacent string.

The bedding or seating product further comprises a first piece of foam having a flat surface proximate the pocketed spring core and rounded peaks and rounded valleys on the opposite side of the first piece of foam. The bedding or seating product further comprises a second piece of foam having rounded peaks and rounded valleys on one side of the second piece of foam nested with the rounded peaks and rounded valleys of the first piece of foam. The first and second pieces of foam may be made of different foams and may have different firmness.

The rounded peaks and rounded valleys of one of the foam pieces may be a different height than the rounded peaks and rounded valleys of the other foam piece to create air channels therebetween to increase airflow and cool the temperature of the product after being subjected to a load.

Cushioning materials including the first and second pieces of foam may be placed on the pocketed spring core, and a covering, usually an upholstered covering, encases the pocketed spring core and cushioning materials.

The rounded peaks and rounded valleys may extend longitudinally (from end-to-end) or transversely (from side-to-side). A bedding or seating product may be posturized into regions or zones of different firmness by incorporating nested pieces of foam into the product having rounded peaks and rounded valleys of different heights.

At least one of the pieces of foam may contain at least one of the following additives: phase change materials, plant-based fibers, synthetic fibers, fragrances, slow-release fragrances, organic and inorganic antimicrobial additives, color additives, thermochromic materials, conductive additive solids, powders, particles, flakes, density reducing agents or gas generating materials. Such additives may impart different properties to the foam layers or pieces such as firmness, for example. The additives may be in the form of conductive solids, powders, particles or flakes.

In another aspect, a bedding or seating product having a core is provided. The core may be a foam core or a pocketed spring core.

The bedding or seating product further comprises a first piece of foam having a flat surface proximate the pocketed spring core and rounded peaks and rounded valleys on the opposite side of the first piece of foam. The bedding or seating product further comprises a second piece of foam having rounded peaks and rounded valleys on one side of the second piece of foam nested with the rounded peaks and rounded valleys of the first piece of foam. The first and second pieces of foam may be made of different foams and may have different firmnesses. The rounded peaks and rounded valleys may extend linearly or in a zig-zag shape/pattern or wave shape/pattern. The rounded peaks and rounded valleys may extend transversely or longitudinally.

The rounded peaks and rounded valleys of one of the foam pieces may be a different height than the rounded peaks and rounded valleys of the other foam piece to create air channels therebetween to increase airflow and cool the temperature of the product after being subjected to a load.

At least some of the foam pieces may contain at least one of the following additives: phase change materials, plant-based fibers such as cellulose, cotton, hemp, linen, jute, wool and the like, synthetic fibers including carbon fiber, nylon, olefin, acrylic, polyester, rayon, vinyon, spandex, vinalon, aramids, Modal, PBI, Orlon and the like, fragrances including slow-release fragrances, organic and inorganic antimicrobial additives such as zinc omadine, N-Butyl-1,2-Benzisothiazonlin-3-one, OIT (2-n-Octyl-4-isothiazolin-3-one, 3-(Trimetholyxysily) proplydimethyloctadecyl ammonium chloride, copper and silver and the like, color additives, thermochromic materials, conductive additive solids, powders, particles, flakes such as activated carbon, carbon nanotubes, graphene, graphite, aluminum powder, silicon carbide, diamond dust and the like may be incorporated into the material. Density reducing agents such as fumed silica or gas generating materials may be added too.

In another aspect, a bedding or seating product is made without a pocketed spring core. The product comprises a first piece of foam having a flat surface and rounded peaks and rounded valleys on the opposite side from the flat surface. The product further comprises a second piece of foam having rounded peaks and rounded valleys nested with the rounded peaks and rounded valleys of the first piece of foam.

At least some of the pieces of foam may contain at least one of the following additives: phase change materials, plant-based fibers, synthetic fibers, fragrances, slow-release fragrances, organic and inorganic antimicrobial additives, color additives, thermochromic materials, conductive additive solids, powders, particles, flakes, density reducing agents or gas generating materials.

One advantage of the present invention is that when a bedding or seating product, such as a mattress, is manufactured, the manufacturer need not purchase adhesive, which may be expensive.

Another advantage of the present invention is that the bedding or seating product, such as a mattress, may impart a cooler "feel" to the user of the bedding or seating product than conventional products.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE INVENTION

Figure 1:
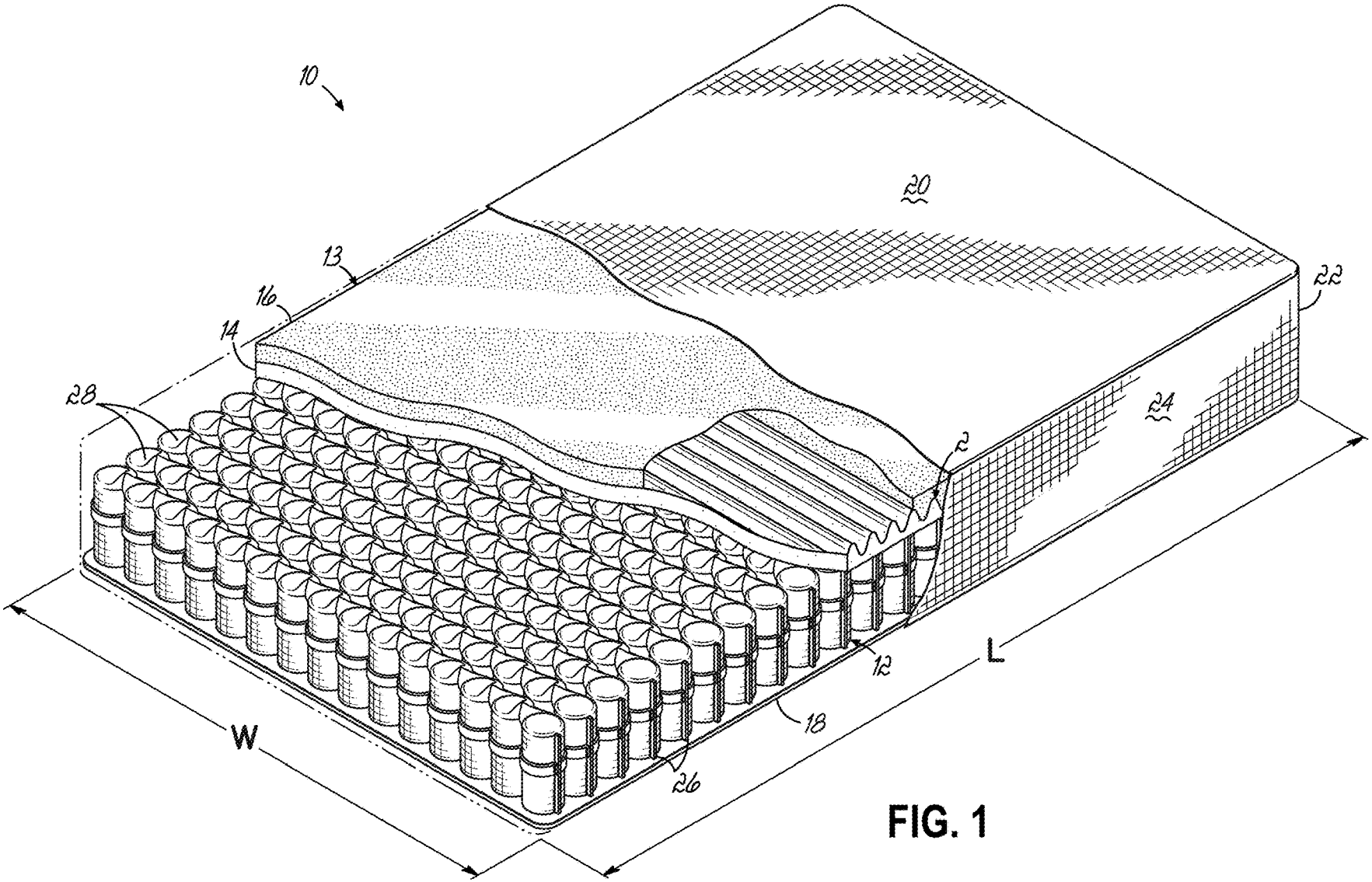
FIG. 1 is a perspective view, partially broken away, of a single-sided bedding product incorporating a pocketed spring core and a cushion comprising nested first and second layers of foam, the rounded peaks and rounded valleys extending transversely.

Referring to FIG. 1, there is illustrated a bedding product in the form of a single-sided mattress 10. This product or mattress 10 comprises a pocketed spring core 12 over the top of which there lay a cushion 13. The cushion comprises first and second convoluted foam layers 14, 16 nested together. The first or inner convoluted foam layer 14 may be made of the same foam or a different foam than the second or outer convoluted foam layer 16. Although each convoluted foam layer is shown as a single piece of foam, any of the foam layers may be made from multiple pieces of foam in any embodiment shown or described herein.

Figure 2:
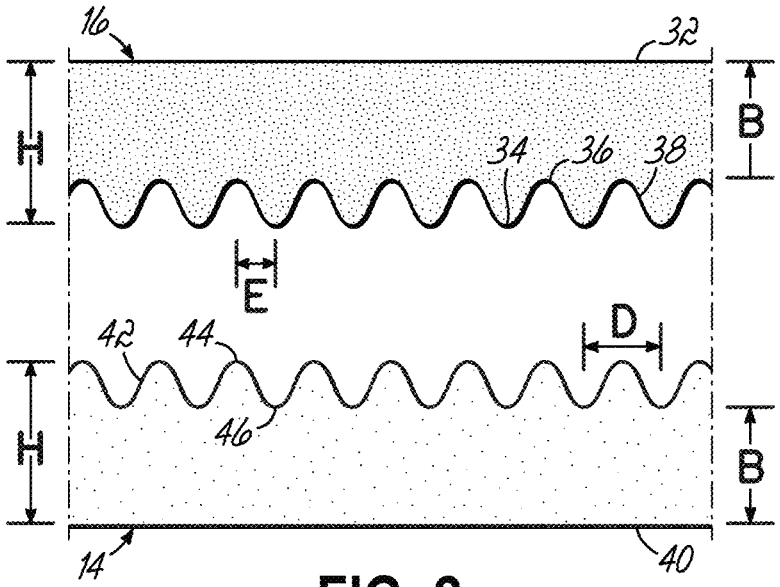
FIG. 2 is an enlarged cross-sectional view of the first and second layers of foam spaced apart.
Figure 2A:
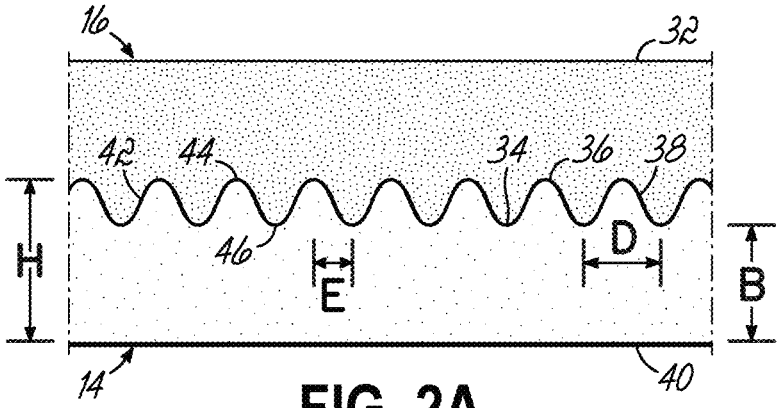
FIG. 2A is an enlarged cross-sectional view of the first and second layers of foam of FIG. 2 in a nested configuration.

FIGS. 2 and 2A show the details of the convoluted foam layers 14, 16 which will be described in more detail below. The pocketed spring core 12 is mounted upon a base 18 and is completely enclosed within an upholstered covering 20. The base 18 may be any known material including a flexible sheet such as a scrim sheet or a more rigid dimensionally stabilizing substrate as described in U.S. Pat. Nos. 11,013,340 and 11,771,235, which are each incorporated by reference herein.

As shown in FIG. 1, fully assembled, the product 10 has a length "L" defined as the linear distance between opposed end surfaces 22 (only one being shown in FIG. 1). Similarly, the assembled product 10 has a width "W" defined as the linear distance between opposed side surfaces 24 (only one being shown in FIG. 1). In the product shown in FIG. 1, the length is illustrated as being greater than the width. However, it is within the scope of the present invention that the length and width may be identical, as in a square product.

As shown in FIG. 1, the pocketed spring core 12 is manufactured from multiple strings 26 of pocketed springs 28 joined together. Although strings 26 of pocketed springs 28 are shown as extending transversely or from side-to-side, they may extend longitudinally or from head-to-foot along the full length of the product 10. The pocketed spring core 12 may be any known pocketed spring core and is not intended to be limited by the drawings.

Figure 1A:
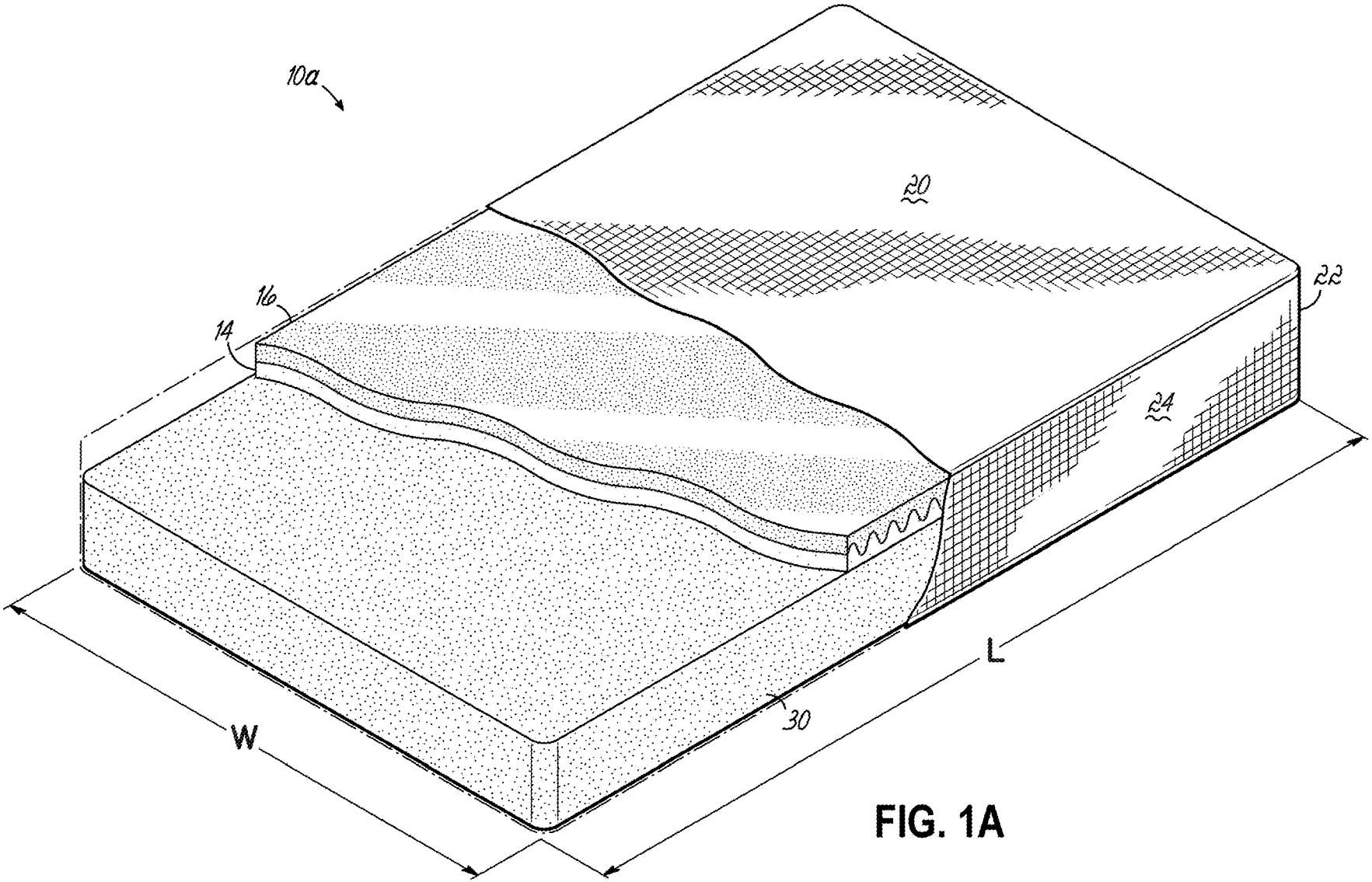
FIG. 1A is a perspective view, partially broken away, of a single-sided bedding product incorporating a foam core and a cushion comprising nested first and second layers of foam, the rounded peaks and rounded valleys extending transversely.

FIG. 1A illustrates a single-sided mattress 10*a* identical to the mattress 10 of FIG. 1 but with foam core 30 in place of the pocketed spring core 12. Although a base is not shown, it is within the scope of the present invention that a base be secured to the foam core 30.

Figure 1B:
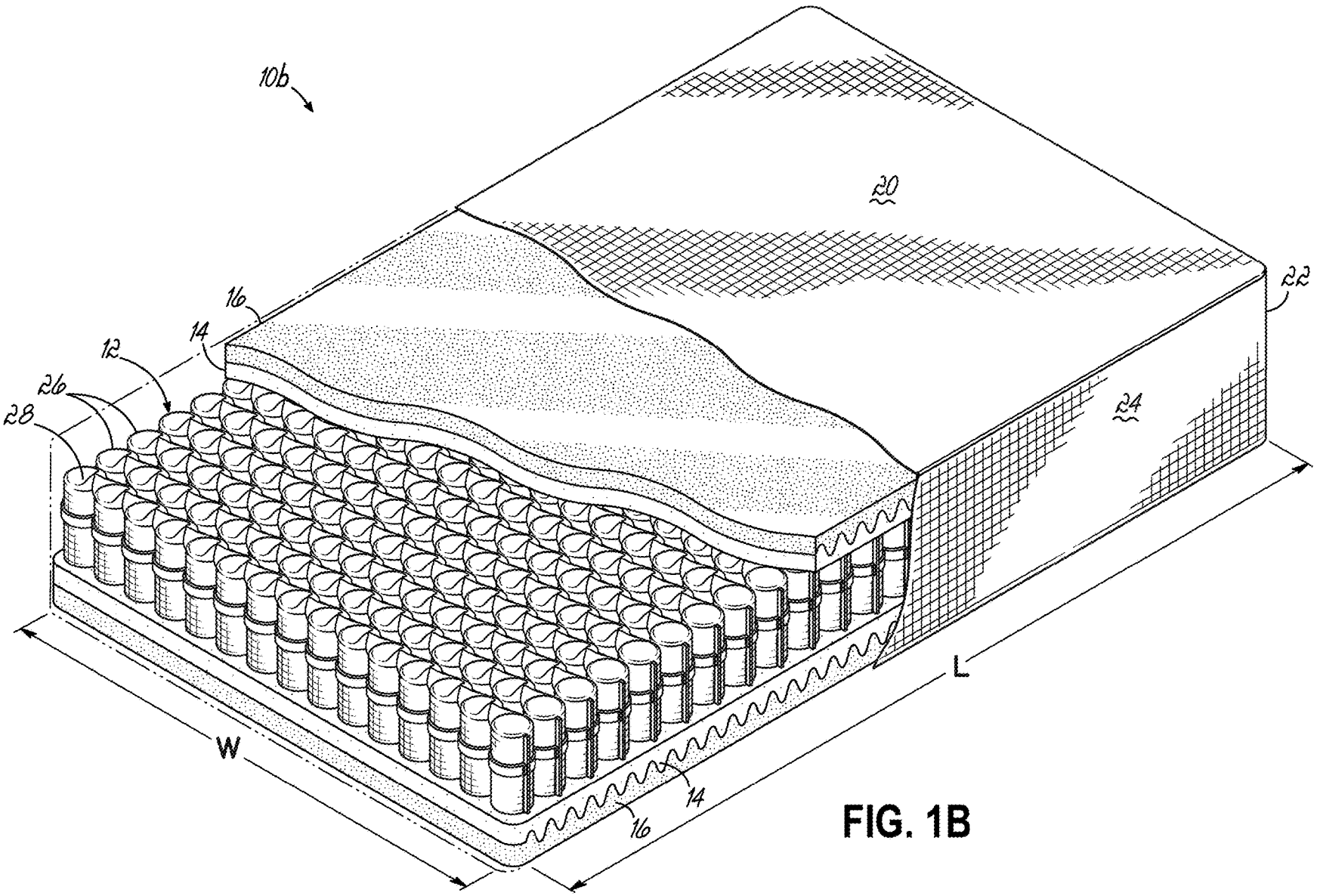
FIG. 1B is a perspective view, partially broken away, of a double-sided bedding product incorporating a pocketed spring core and a first cushion comprising nested first and second layers of foam above the pocketed spring core and a second cushion comprising nested first and second layers of foam below the pocketed spring core.

FIG. 1B illustrates a double-sided mattress 10*b* having a pocketed spring core 12 as its core. However, the mattress 10*b* of FIG. 1B has convoluted foam layers 14, 16 above and below the pocketed spring core 12. The pocketed spring core 12 comprises a plurality of strings 26 extending from side to side or transversely. However, the transversely extending strings could be longitudinally extending or extend from head-to-foot. A foam core may be used in place of the pocketed spring core 12 in such a double-sided mattress or product.

Figure 1C:
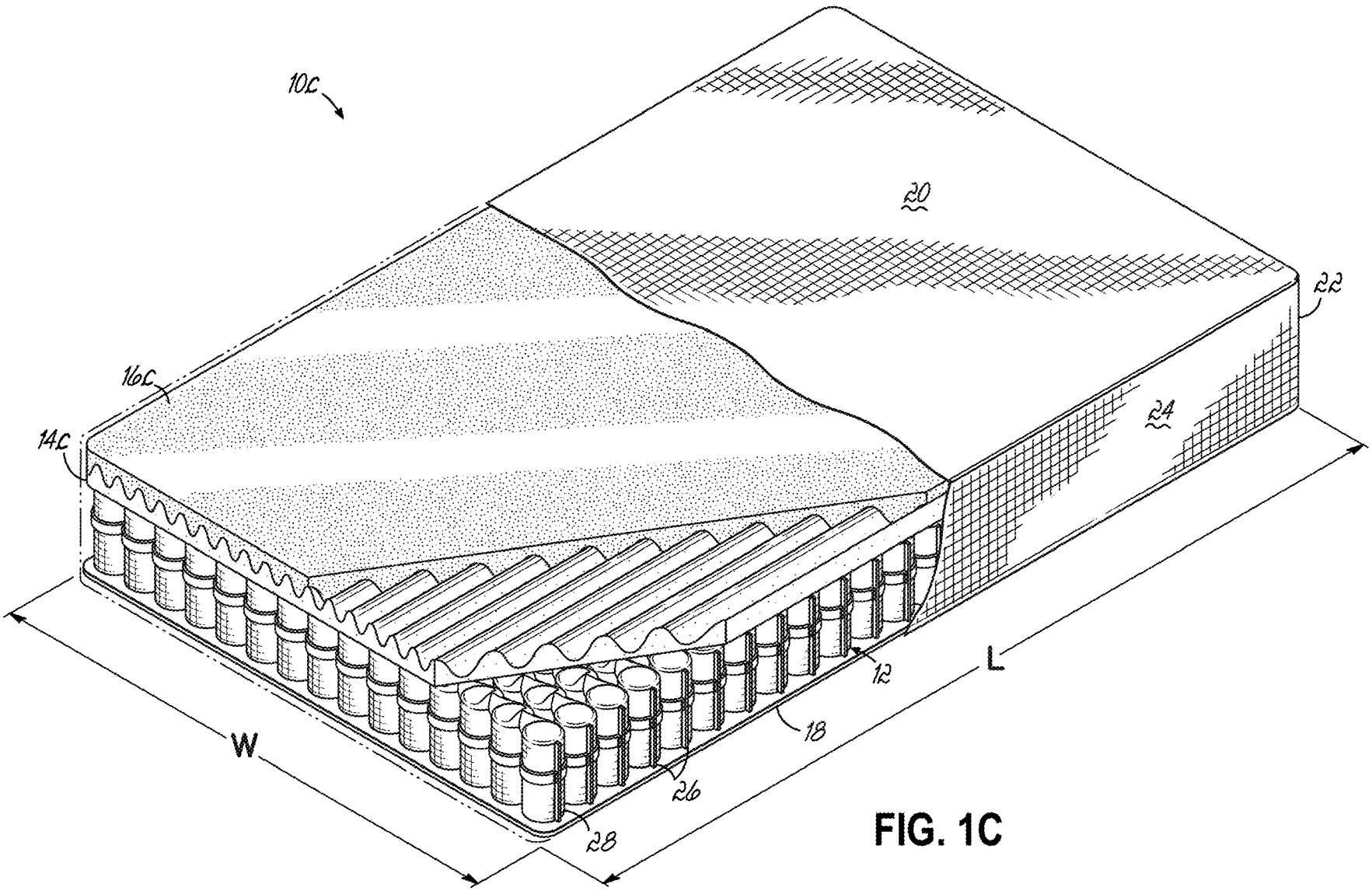
FIG. 1C is a perspective view, partially broken away, of another single-sided bedding product incorporating the pocketed spring core of FIG. 1 and a cushion comprising nested first and second layers of foam, the rounded peaks and rounded valleys extending longitudinally.

FIG. 1C illustrates a single-sided mattress 10*c* comprising a pocketed spring core 12. Mattress 10*c* of FIG. 1C has convoluted foam layers 14*c*, 16*c* above the pocketed spring core 12 but is otherwise identical to mattress 10 of FIG. 1. Convoluted foam layers 14*c*, 16*c* differ from convoluted foam layers 14, 16 in that the rounded peaks and rounded valleys extend longitudinally in convoluted foam layers 14*c*, 16*c*, as opposed to extending transversely or from side-to-side in convoluted foam layers 14, 16. The rounded peaks and rounded valleys of convoluted foam layers 14*c*, 16*c* are shown as extending linearly or in a straight line, as are the rounded peaks and rounded valleys of convoluted foam layers 14, 16. For purposes of this document, a convoluted foam piece having these straight rounded peaks and valleys will be referred to as "furrowed".

Figure 1D:
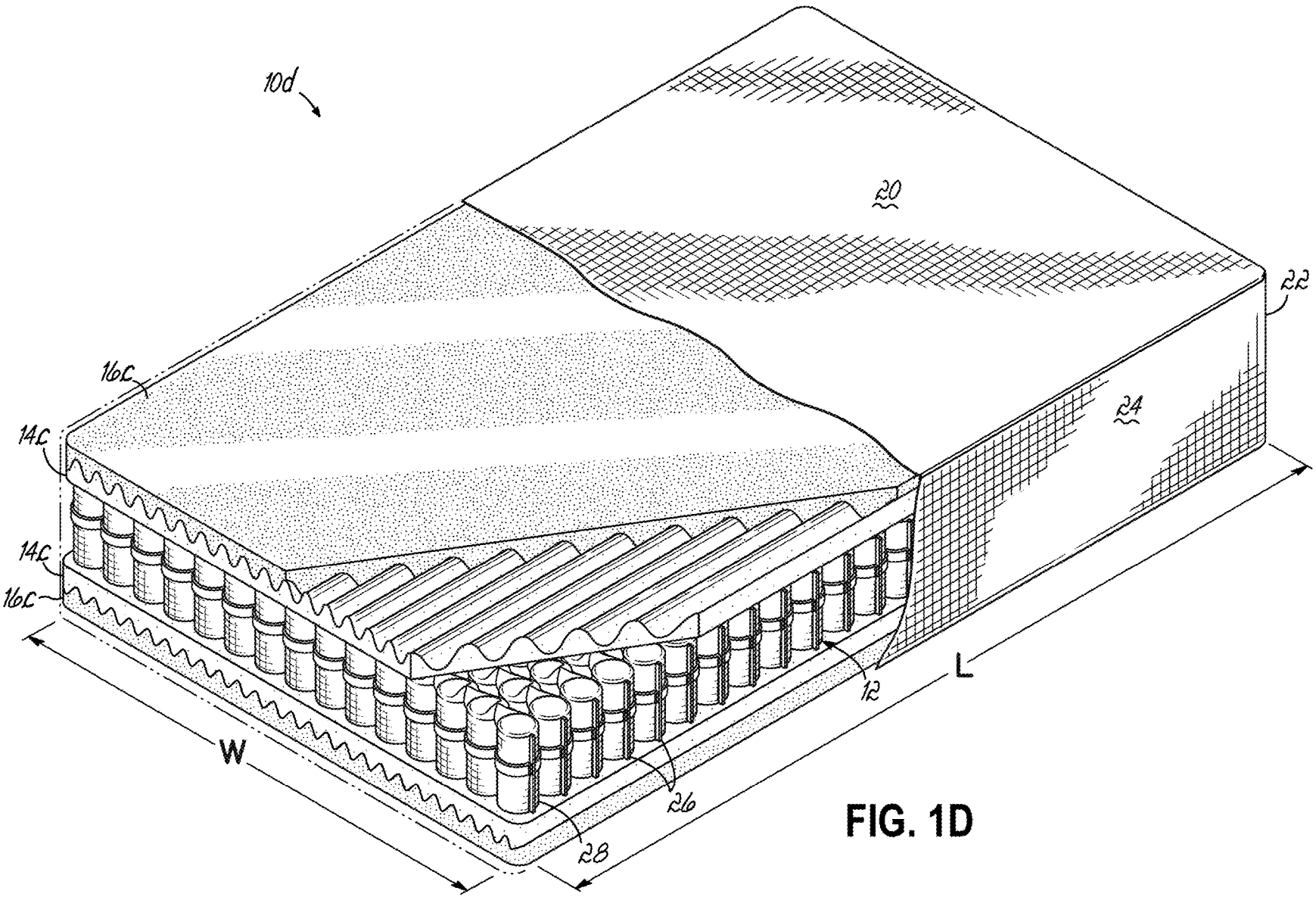
FIG. 1D is a perspective view, partially broken away, of another double-sided bedding product incorporating a pocketed spring core and upper and lower cushions, each cushion comprising nested first and second layers of foam, the rounded peaks and rounded valleys extending longitudinally.

FIG. 1D illustrates a double-sided mattress 10*d* comprising pocketed spring core 12, the same as in the mattress 10 of FIG. 1. The mattress 10*d* of FIG. 1D is identical to mattress 10*c* of FIG. 1C but has a second set of convoluted foam layers 14*c*, 16*c*.

In any of the bedding or seating products shown or described herein, including mattresses 10, 10*a*, 10*b*, 10*c* and 10*d*, either a foam core 30 or a pocketed spring core 12 may be used as the core of the product. The drawings are not intended to be limiting.

FIG. 2 illustrates an enlarged portion of convoluted foam layers 14, 16 before being nested together. FIG. 2A illustrates an enlarged portion of convoluted foam layers 14, 16 nested together. Outer convoluted foam layer 16 has a flat or planar outer surface 32 and a plurality of rounded peaks 34 and rounded valleys 36 on a convoluted surface 38. Similarly, inner convoluted foam layer 14 has a flat or planar surface 40 and a convoluted opposite surface 42 having a plurality of rounded peaks 44 and rounded valleys 46.

The linear distance "D" between adjacent rounded peaks of either convoluted foam layer 14, 16 may be between 1-6 inches but is preferably between 2-4 inches. The linear distance "E" between an adjacent peak and valley is preferably between 0.5 to 6.0 inches. The overall height "H" of one of the convoluted pieces 14, 16 may be between 2-4 inches with the base "B" being between 1-3 inches. In one embodiment, the height H of a convoluted foam piece is 3 inches and the base 2 inches.

Figure 3:
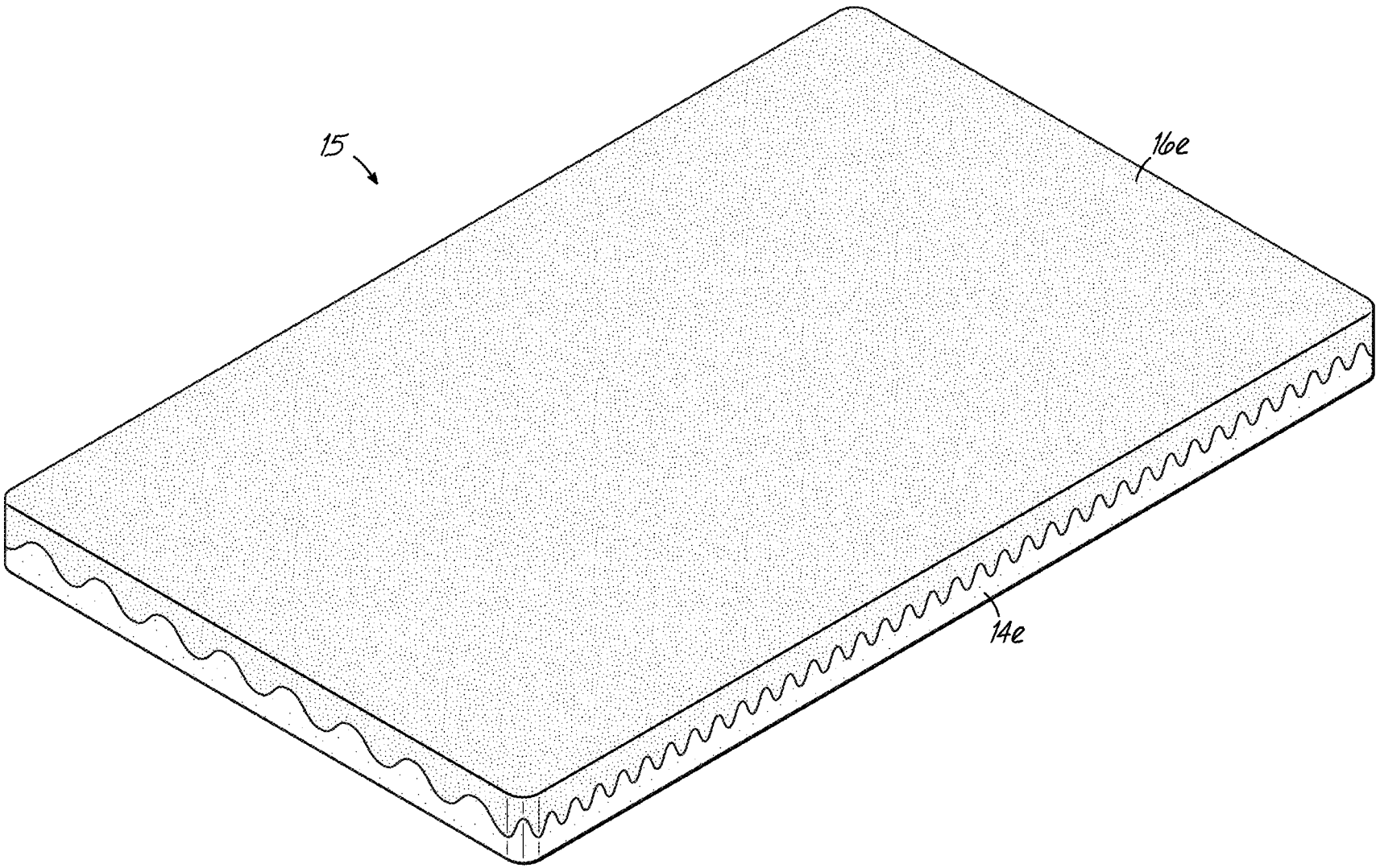
FIG. 3 is a perspective view of a cushion comprising first and second convoluted foam layers nested together, the foam layers having wave or zig-zag shaped convolutions.

FIG. 3 illustrates a cushion 15 comprising first and second convoluted foam layers 14*e*, 16*e*. The first convoluted foam layer 14*e* may be made of the same foam or a different foam than the second convoluted foam layer 16*e*. This cushioning layer 15 may be used in any of the bedding or seating products shown or described herein. Each of the convoluted foam layers 14*e*, 16*e*, instead of having straight rounded peaks and valleys on one side thereof, has rounded peaks and rounded valleys in a zig-zag shape on one side thereof. The rounded peaks and rounded valleys of foam pieces 14*e* and 16*e* of foam layers 14*e*, 16*e* nest together, either in a transverse direction (from side-to-side) or in a longitudinal direction (from end to end). Each of the rounded peaks and rounded valleys is zig-zag shaped or wave-shaped along its length, rather than linear. The zig-zag shaped rounded peaks and valleys may be any desired size and are not intended to be limited by the drawings.

Figure 3A:
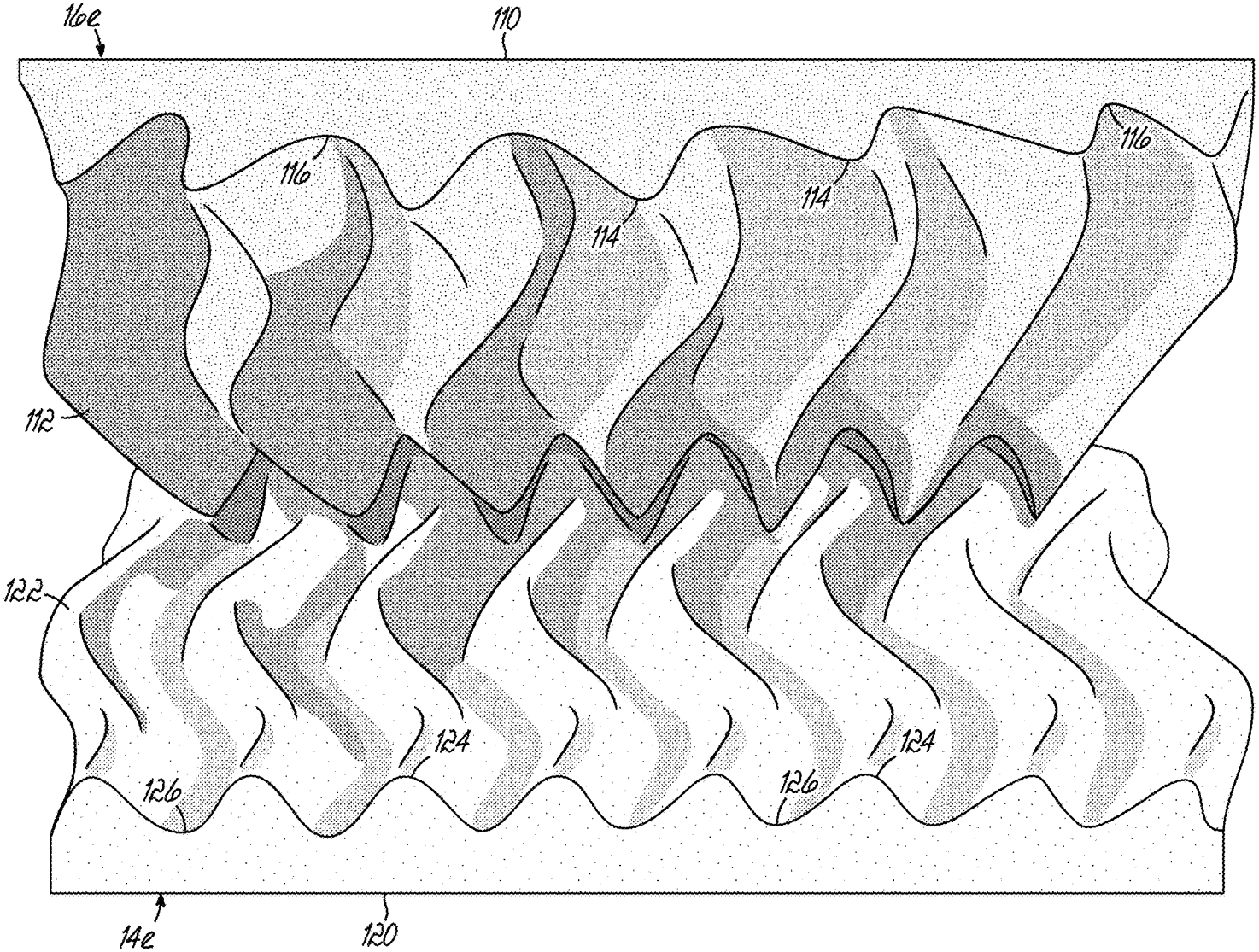
FIG. 3A is a perspective view, partially separated, of the foam cushion of FIG. 3 showing the wave or zig-zag shaped convolutions with rounded peaks and valleys extending in a wave or zig-zag pattern.
Figure 3B:
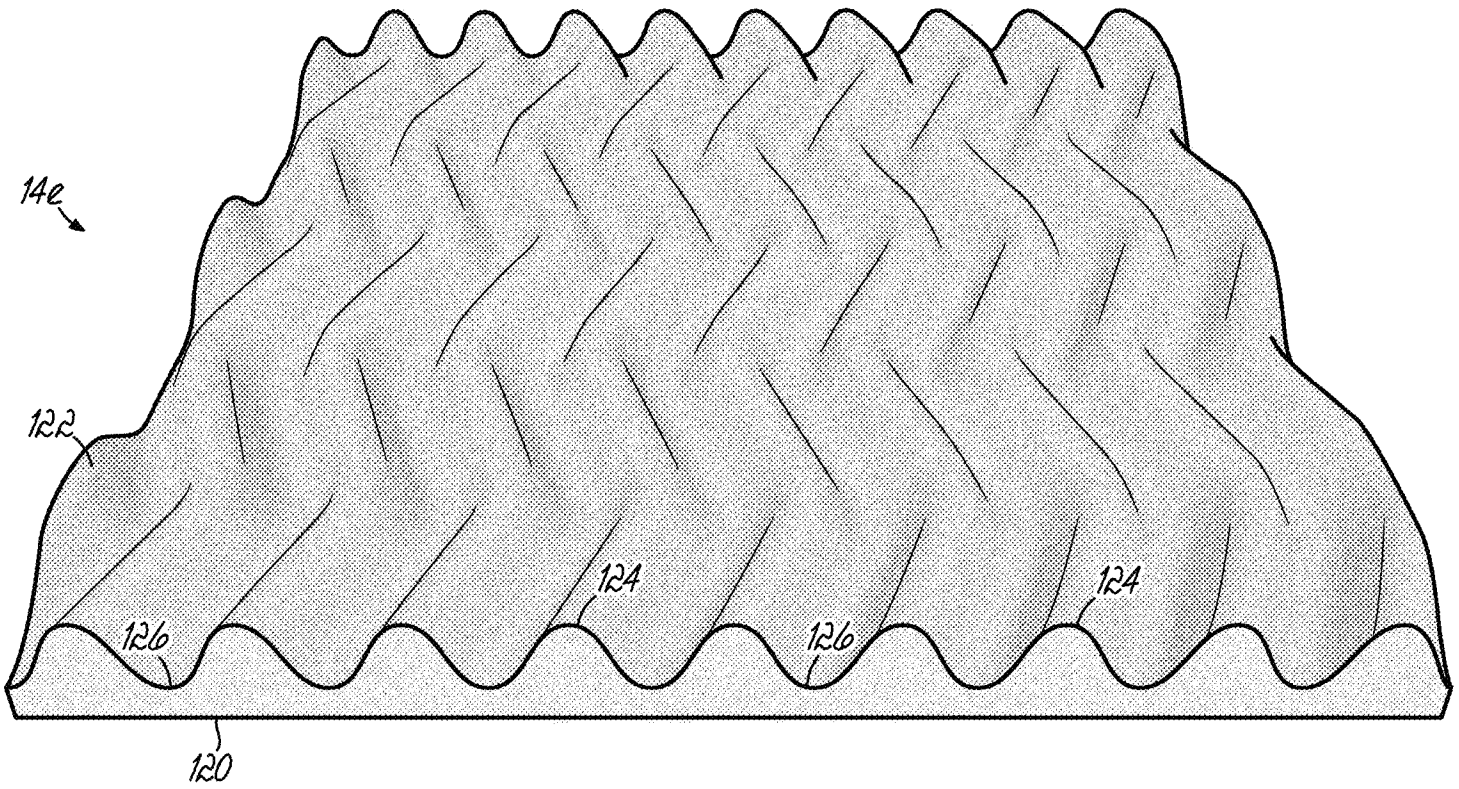
FIG. 3B is a perspective view of the lower foam layer of the foam cushion of FIG. 3 showing the wave or zig-zag shaped convolutions with rounded peaks and valleys extending in a wave or zig-zag pattern.

As best shown in FIG. 3A, outer foam layer 16*e* has a flat outer surface 110 and a convoluted inner surface 112 comprising rounded peaks 114 and rounded valleys 116 extending in a wave or zig-zag configuration. Similarly, inner foam layer 14*e* has a flat outer surface 120 and a convoluted inner surface 122 comprising rounded peaks 124 and rounded valleys 126 extending in a wave or zig-zag configuration. As best shown in FIGS. 3 and 3A, despite their wave or zig-zag configuration, the rounded peaks 114 and rounded valleys 116 of outer foam layer 16*e* nest inside the rounded valleys 126 and rounded peaks 124 of inner foam layer 14*e*.

Figure 4:
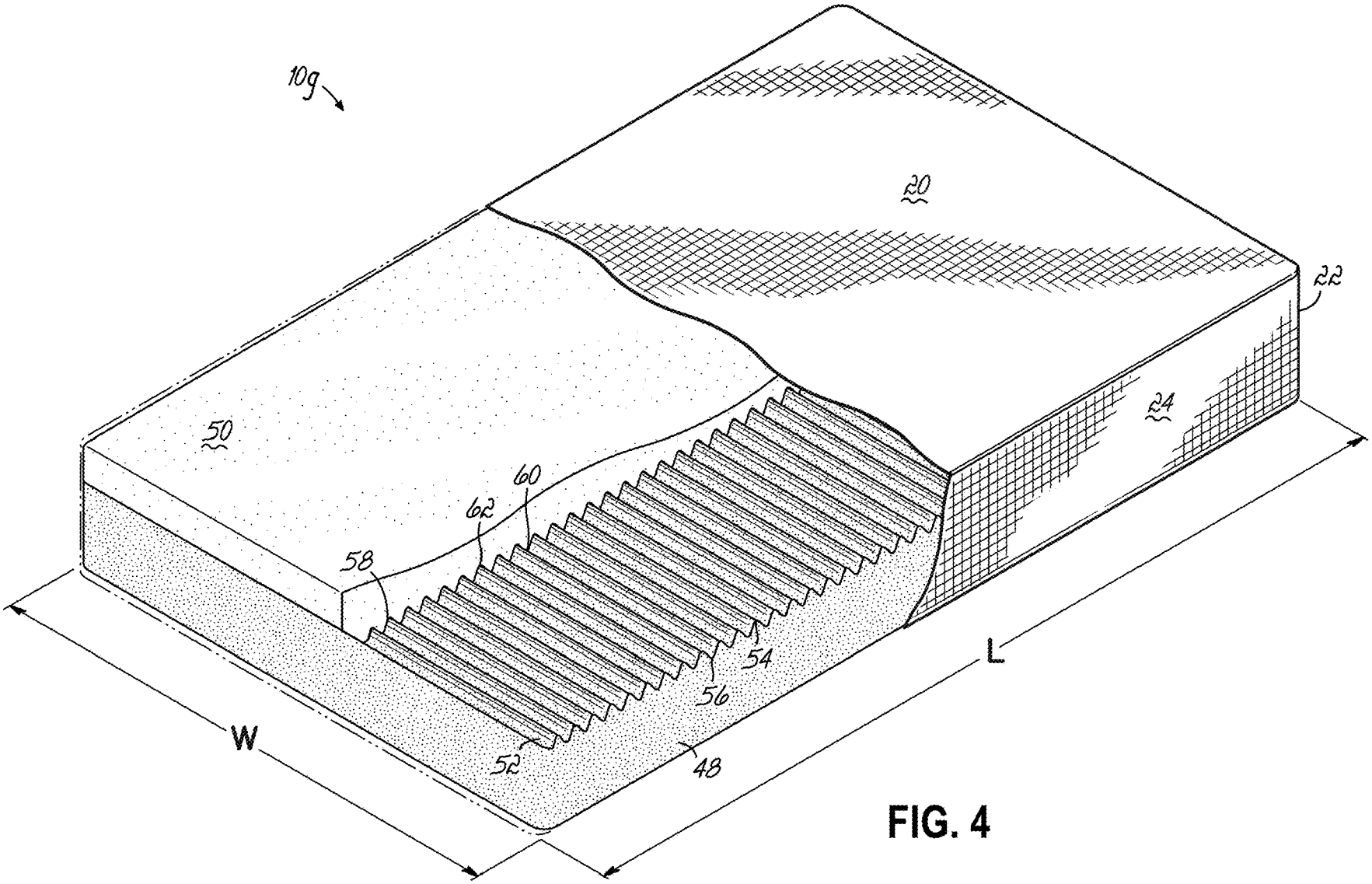
FIG. 4 is a perspective view, partially broken away, of another embodiment of single-sided bedding product made without pocketed springs and comprising two pieces of foam having nested rounded peaks and rounded valleys extending transversely and being linear.

FIG. 4 illustrates another embodiment of mattress 10*g* which comprises a lower foam layer 48 and an upper foam layer 50 encased in a cover 20. The lower foam piece 48 has a convoluted upper surface 52 comprising linear rounded peaks 54 and linear rounded valleys 56 extending in a transverse or side-to-side direction. The upper foam layer 50 has a convoluted lower surface 58 comprising linear rounded peaks 60 and linear rounded valleys 62 extending in a transverse or side-to-side direction. The rounded peaks and rounded valleys of foam layers 48 and 50 nest together, as shown. Although not shown, each of the rounded peaks and rounded valleys of foam layers 48, 50 may be zig-zag shaped or wave-shaped along its length, rather than linear. Although not shown, one or more conventional pieces of foam may be on top of the upper foam piece 50 and inside cover 20. Although lower foam layer 48 is shown being thicker than upper foam layer 50, these foam layers may be the same size or any desired size. The drawings are not intended to be limiting.

Figure 4A:
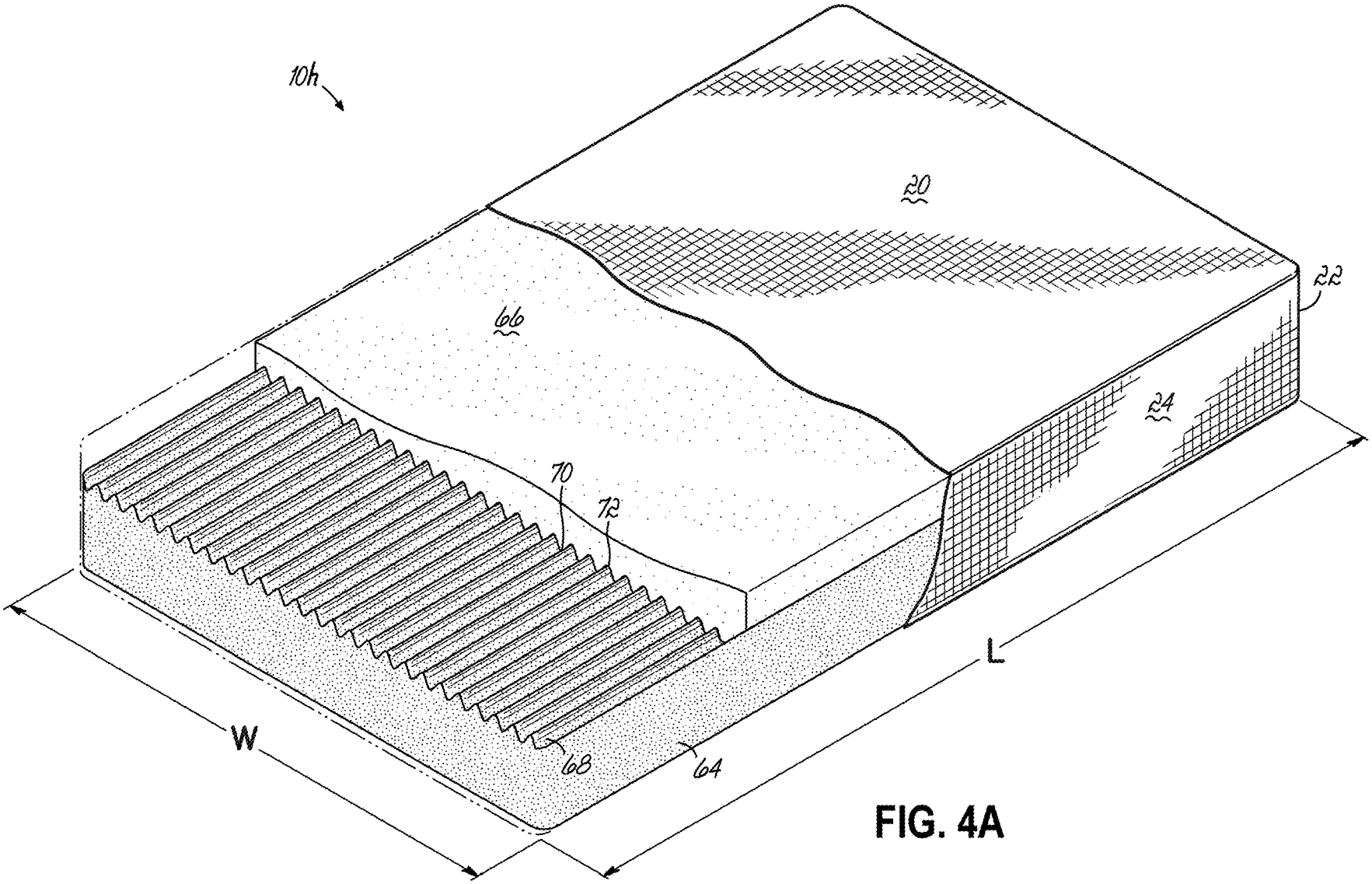
FIG. 4A is a perspective view, partially broken away, of another embodiment of single-sided bedding product made without pocketed springs and comprising two pieces of foam having nested rounded peaks and rounded valleys extending longitudinally and being linear.

FIG. 4A illustrates another embodiment of mattress 10*h*, similar to mattress 10*g* of FIG. 4, but having different convoluted lower and upper foam layers 64, 66. The lower foam layer 64 has a convoluted upper surface 68 comprising linear rounded peaks 70 and linear rounded valleys 72 extending in a longitudinal or end-to-end direction. The upper foam layer 66 has a convoluted lower surface 74 comprising linear rounded peaks 76 and linear rounded valleys 78 extending in a longitudinal or end-to-end direction. The rounded peaks and rounded valleys of foam layers 64 and 66 nest together, as shown. Although not shown, each of the rounded peaks and rounded valleys of foam layers 64, 66 may be zig-zag shaped or wave-shaped along its length, rather than linear. Although not shown one or more conventional pieces of foam may be on top of the upper foam piece 66 and inside cover 20. Although lower foam layer 64 is shown being thicker than upper foam layer 66, these foam layers may be the same size or any desired size. The drawings are not intended to be limiting.

Figure 5:
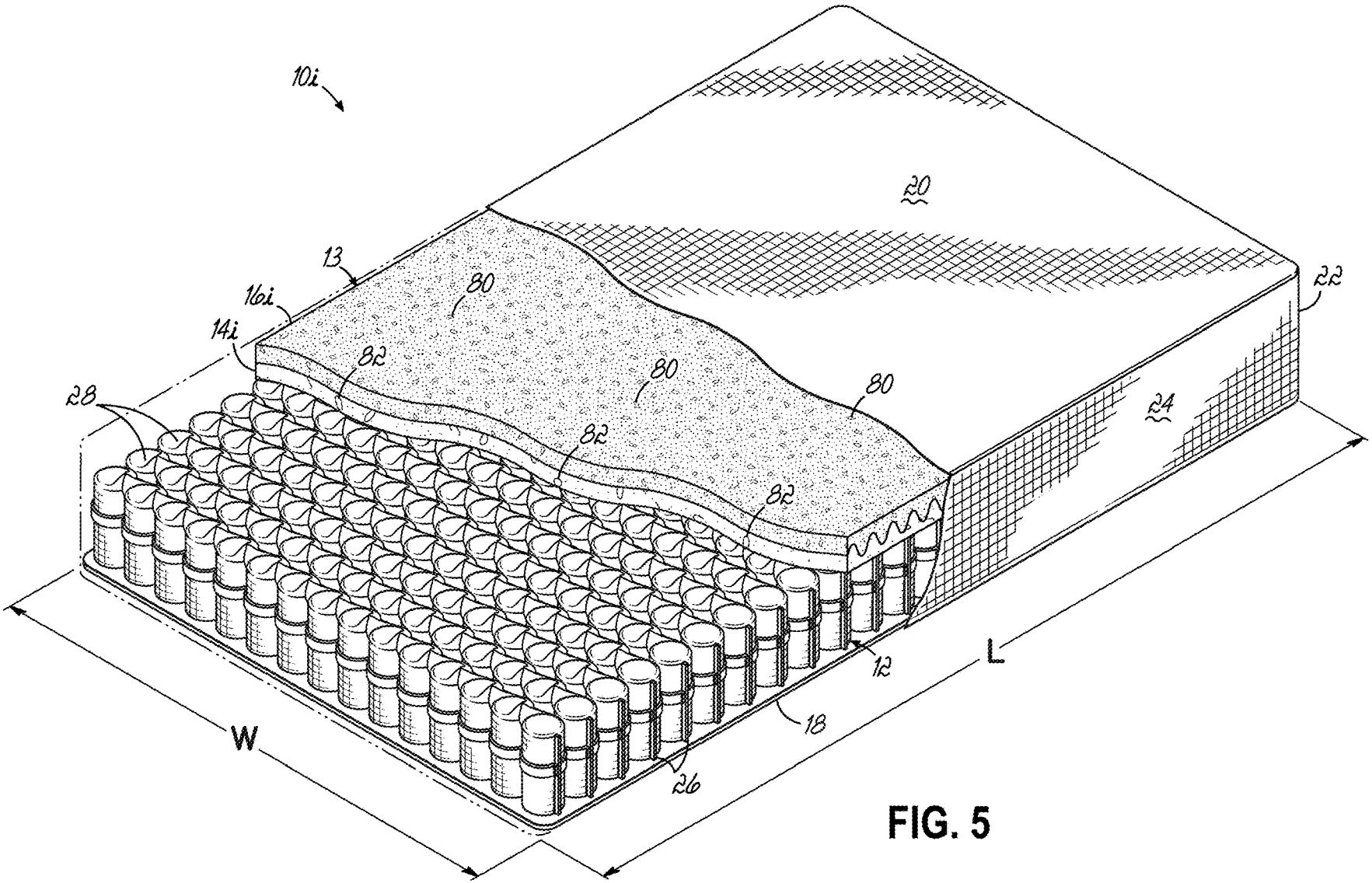
FIG. 5 is a perspective view, partially broken away, of another embodiment of single-sided bedding product made with pocketed springs and the two layers of nested foam having additives, the rounded peaks and rounded valleys extending transversely and linearly.

FIG. 5 illustrates another embodiment of mattress 10*i* having different convoluted foam layers 14*i*, 16*i*. Each of the convoluted foam layers 14*i*, 16*i* has rounded peaks and rounded valleys on one side thereof. The rounded peaks and rounded valleys of foam layers 14*i* and 16*i* nest together and extend, as shown, in a transverse direction or from side-to-side. Although each of the rounded peaks and rounded valleys is shown extending in a straight direction, each may be zig-zag shaped or wave-shaped along its length, rather than linear. The upper convoluted foam layer 16*i* is shown having conductive additive solids, powders, particles or flakes 80. The lower convoluted foam piece 14*i* as having gel capsules of phase change materials 82.

Figure 5A:
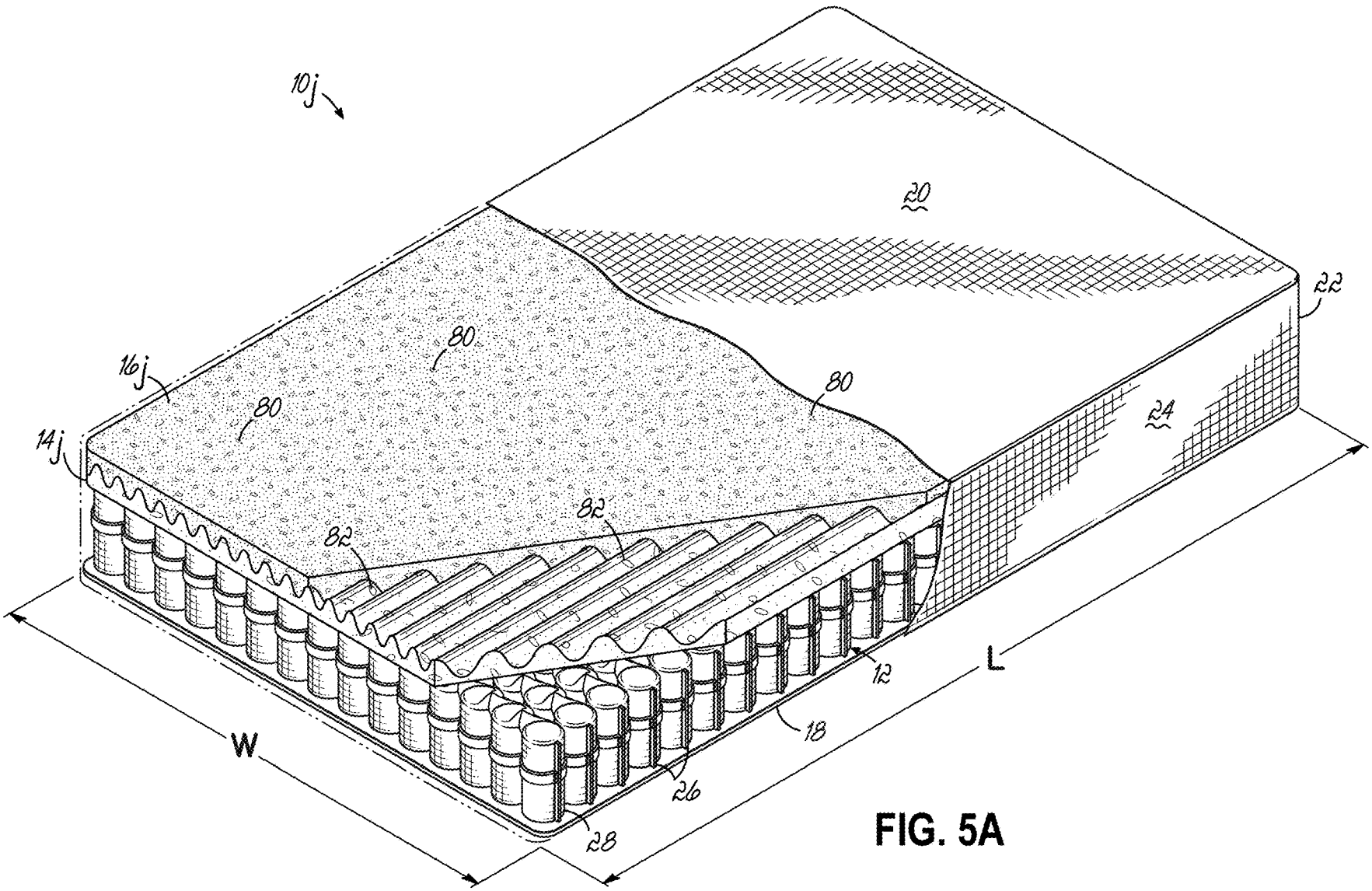
FIG. 5A is a perspective view, partially broken away, of another embodiment of single-sided bedding product made with pocketed springs and the two layers of nested foam having additives, the rounded peaks and rounded valleys extending longitudinally and linearly.

FIG. 5A illustrates another embodiment of mattress 10*j*, similar to mattress 10*i* of FIG. 3 but having different convoluted foam layers 14*j*, 16*j*. Each of the convoluted foam layers 14*j*, 16*j* has rounded peaks and rounded valleys on one side thereof. The rounded peaks and rounded valleys of foam layers 14*j* and 16*j* nest together, as shown in a longitudinal direction or from end-to-end. Each of the rounded peaks and rounded valleys may be zig-zag shaped or wave shaped along its length, rather than linear as shown. The upper convoluted foam layer 16*j* is shown having conductive additive solids, powders, particles or flakes 80. The lower convoluted foam layer 14*j* is shown having gel capsules of phase change materials 82.

Figure 6:
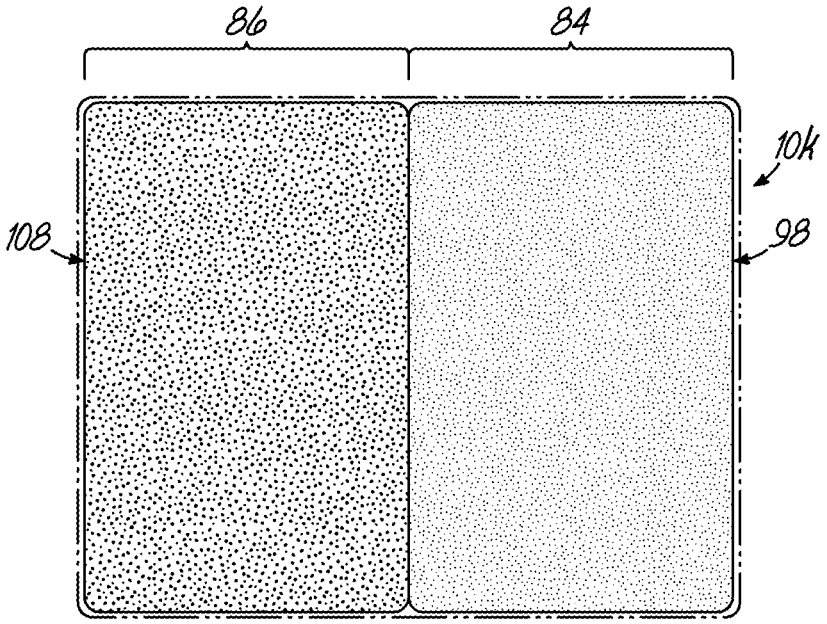
FIG. 6 is a top view of an alternative bedding product.
Figure 6A:
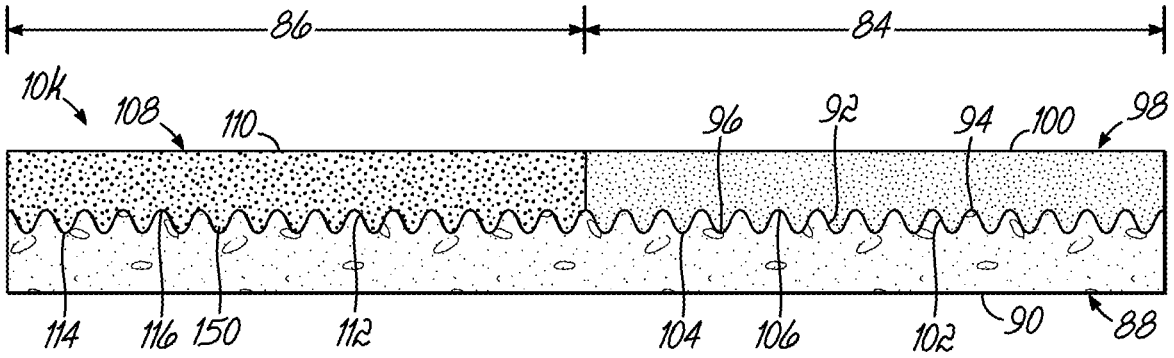
FIG. 6A is a cross-sectional view of the bedding product of FIG. 6.

FIGS. 6 and 6A illustrate another embodiment of mattress 10*k* divided into first and second sections 84, 86, respectively, having different characteristics, such as firmness or cooling capability, for example. Mattress 10*k* comprises a base foam layer 88 having a flat bottom surface 90 and a convoluted upper surface 92 comprising rounded peaks 94 and rounded valleys 96.

Mattress 10*k* further comprises an upper foam piece 98 in the first section 84 having a flat upper surface 100 and a convoluted lower surface 102 comprising rounded peaks 104 and rounded valleys 106 nested with the rounded peaks 94 and rounded valleys 96 of the base foam layer 88. The foam piece 98 may be made of a different foam than the foam of the base foam layer 88.

Mattress 10*k* further comprises an upper foam piece 108 in the second section 86 having a flat upper surface 100 generally coplanar with the flat upper surface 100 of the adjacent upper foam piece 98. The upper foam piece 108 has a convoluted lower surface 112 comprising rounded peaks 114 and rounded valleys 116 nested with the rounded peaks 94 and rounded valleys 96 of the base foam layer 88. The upper foam piece 108 may be made of a different foam than the foam of the base foam layer 88 and different than the foam of the upper foam piece 98. FIGS. 6 and 6A illustrate the upper foam piece 108 having conductive additive solids, powders, particles or flakes. Although not shown upper foam piece 98 may have conductive additive solids, powders, particles or flakes. The base foam layer 88 may have phase change gel particles and/or conductive additive solids, powders, particles or flakes.

Figure 7:
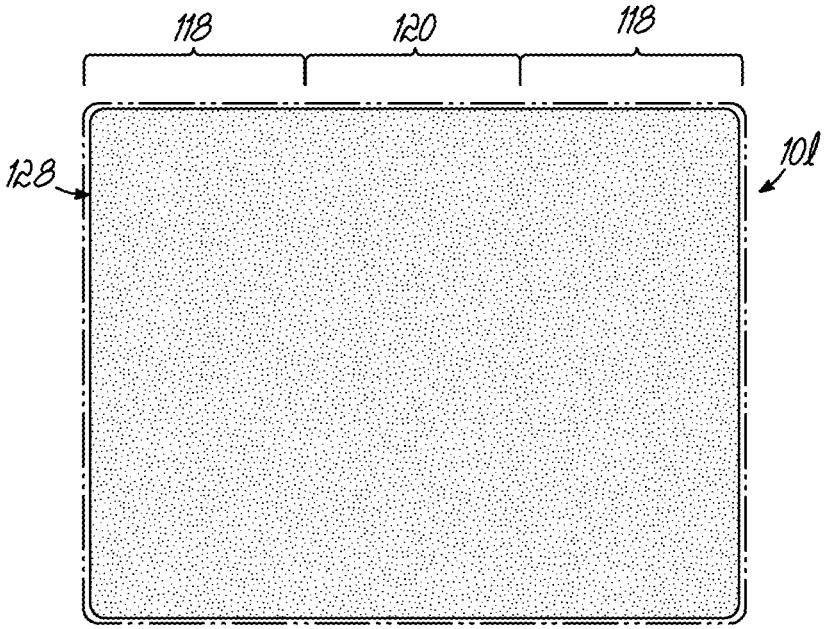
FIG. 7 is a top view of an alternative bedding product.
Figure 7A:
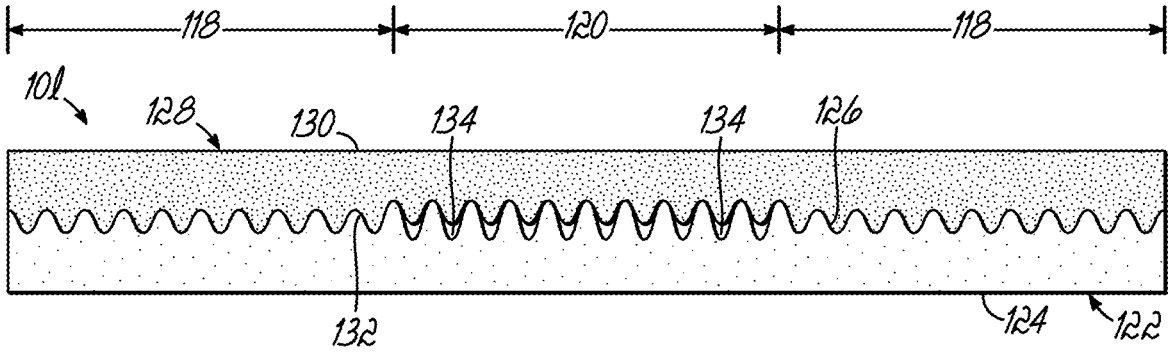
FIG. 7A is a cross-sectional view of the bedding product of FIG. 7.

FIGS. 7 and 7A illustrate another embodiment of mattress 10*l* divided into two identical end sections 118 and a middle section 120, having different characteristics, such as firmness or cooling capability, for example. Mattress 10*l* comprises a base foam piece 122 having a flat bottom surface 124 and a convoluted upper surface 126 comprising rounded peaks and rounded valleys. The rounded peaks and rounded valleys in the middle section 120 are larger than the rounded peaks and rounded valleys of the end sections 118. Mattress 10*l* further comprises a top foam piece 128 having a flat upper surface 130 and a convoluted lower surface 132 comprising rounded peaks and rounded valleys. The rounded peaks and rounded valleys in the middle section 120 are smaller than the rounded peaks and rounded valleys of the end sections 118. The rounded peaks and rounded valleys of the foam pieces 122, 128 are nested such that air gaps 134 are created in only the middle section 120 of mattress 10*l*. The air gaps 134 provide increased air flow in the middle section 120 compared to the end sections 118, resulting in a cooler sleeping surface when a load is placed thereon.

Figure 8:
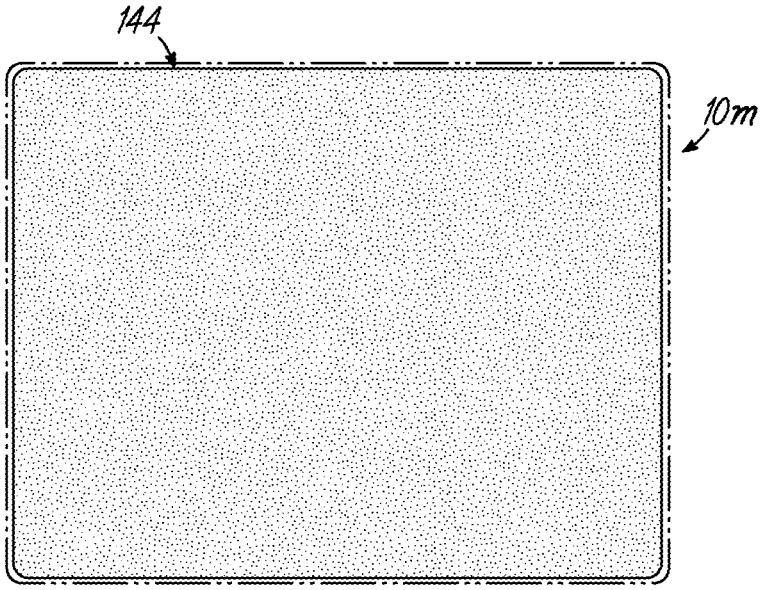
FIG. 8 is a top view of an alternative bedding product.
Figure 8A:
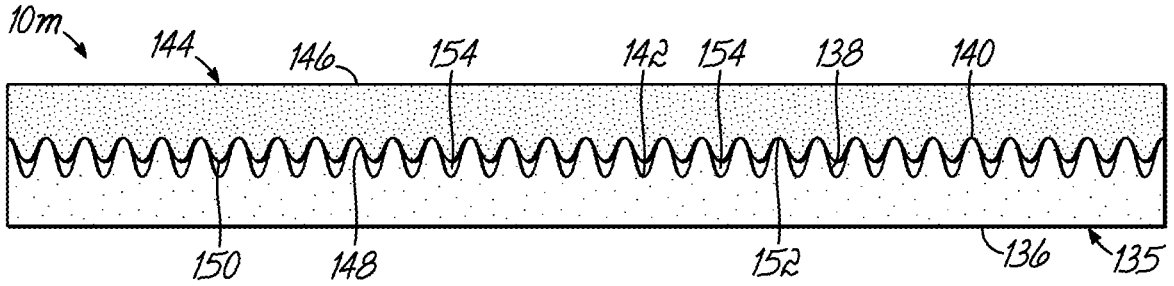
FIG. 8A is a cross-sectional view of the bedding product of FIG. 8.

FIGS. 8 and 8A illustrate another embodiment of mattress 10*m* which has uniform characteristics throughout; it is not postured into sections. Mattress 10*m* comprises a base foam piece 135 having a flat bottom surface 136 and a convoluted upper surface 138 comprising rounded peaks 140 and rounded valleys 142. Mattress 10*m* further comprises a top foam piece 144 having a flat upper surface 146 and a convoluted lower surface 148 comprising rounded peaks 150 and rounded valleys 152. The rounded peaks 150 and rounded valleys 152 of the top foam piece 138 are smaller than the rounded peaks 140 and rounded valleys 142 of the base foam piece 135. The rounded peaks and rounded valleys of the foam pieces 134, 138 are nested such that air gaps 154 are created throughout the mattress 10*m*. The air gaps 154 provide increased air flow in the mattress 10*m*, resulting in a cooler sleeping surface than a mattress with no air gaps when a load is placed thereon.

Figure 9:
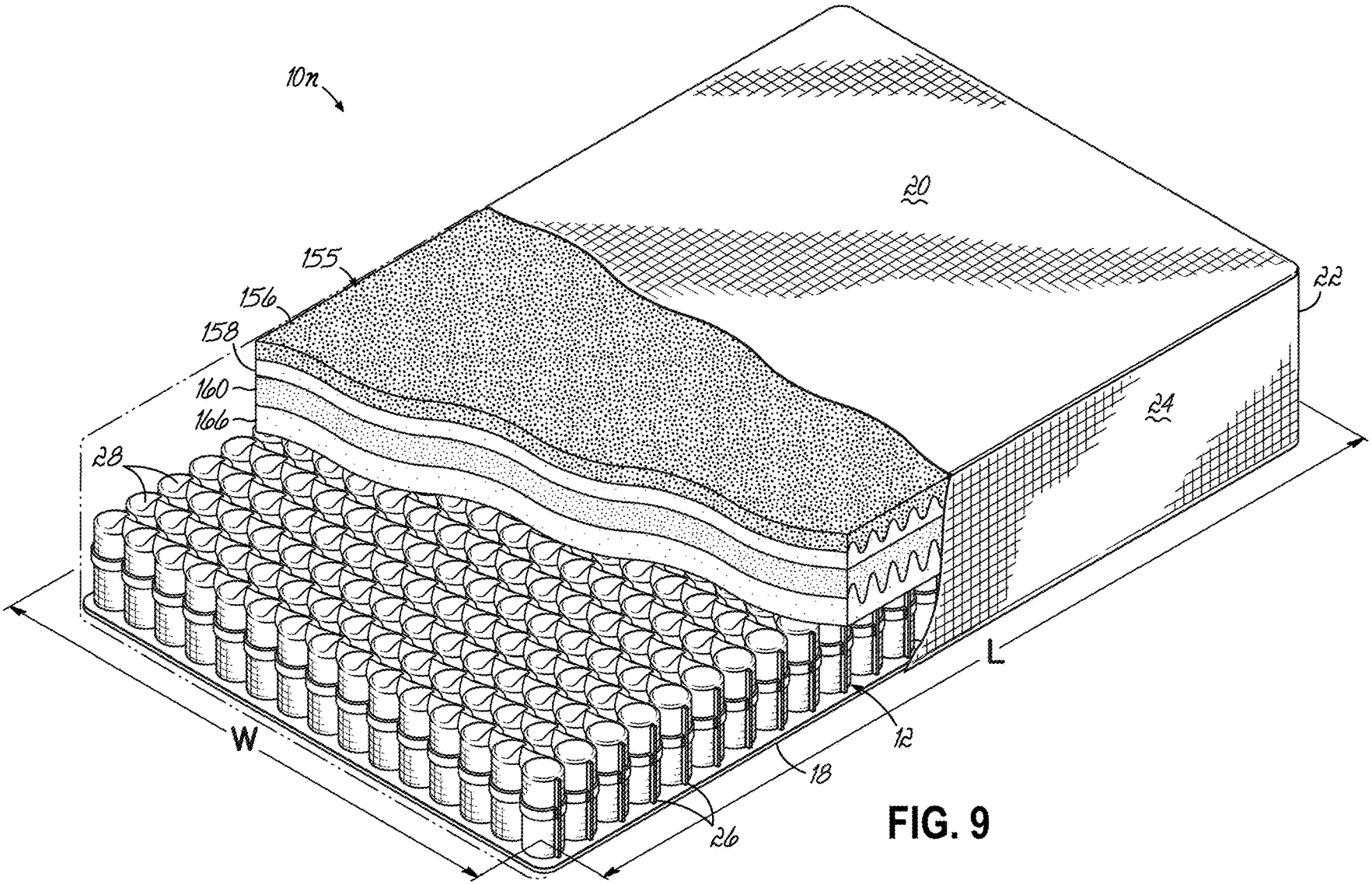
FIG. 9 is a perspective view, partially broken away, of another embodiment of single-sided bedding product having a foam construction or cushion as shown in FIG. 9A.
Figure 9A:
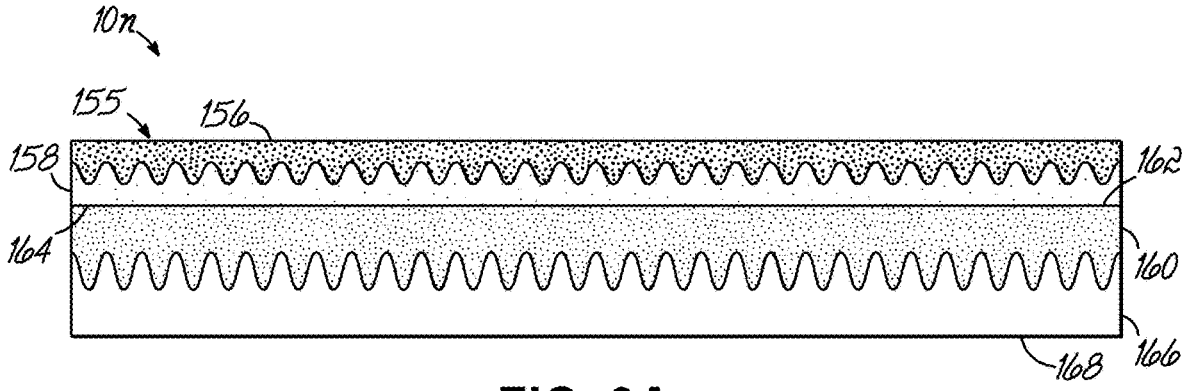
FIG. 9A is a cross-sectional view of the multi-layer cushion of FIG. 9.

FIGS. 9 and 9A illustrate another embodiment of single-sided mattress 10*n* identical to mattress 10 of FIG. 1 but having a different foam construction 155 above the pocketed spring core 12. As best shown in FIG. 9A, the foam construction 155 comprises an upper layer of foam 156 being nested with a second layer of foam 158 in accordance with the principles of the present invention. Additionally, a third layer of foam 160 is underneath the second layer of foam 158 with a flat surface 162 of the second layer of foam 158 abutting a flat surface 164 of the third layer of foam 160. The foam construction 155 further comprises a lower or fourth layer of foam 166 being nested with the third layer of foam 160 in accordance with the principles of the present invention. A flat surface 168 of the lower or fourth layer of foam 166 abuts the pocketed spring core 12.

Figure 10A:
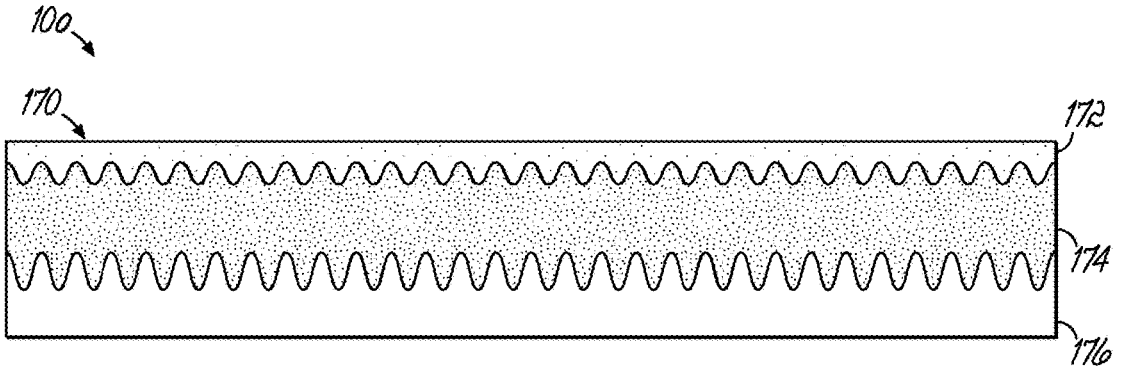
FIG. 10A is a cross-sectional view of the cushion of FIG. 10.
Figure 10:
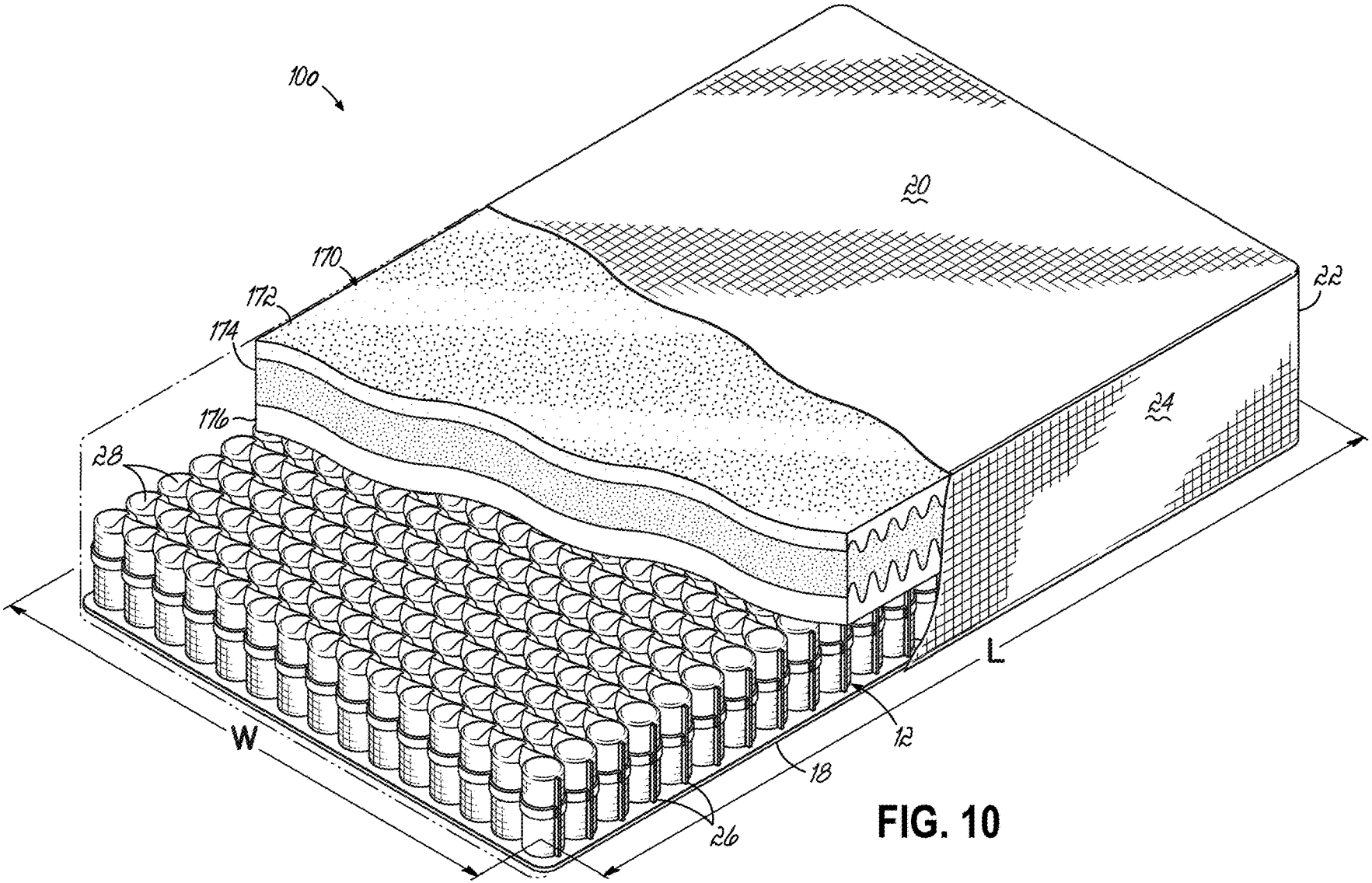
FIG. 10 is a perspective view, partially broken away, of another embodiment of single-sided bedding product having a foam construction or cushion as shown in FIG. 10A.

FIGS. 10 and 10A illustrate another embodiment of single-sided mattress 10*o* identical to mattress 10 of FIG. 1 but having a different foam construction 170 above the pocketed spring core 12. As best shown in FIG. 10A, the foam construction 170 comprises an upper layer of foam 172 being nested with a middle layer of foam 174 in accordance with the principles of the present invention. Additionally, a third or lower layer of foam 176 is underneath the middle layer of foam 174. The middle layer of foam 174 of foam construction 170 has convoluted upper and lower surfaces and is nested with the upper and lower layers of foam 172, 176 in accordance with the principles of the present invention. A flat surface 168 of the lower or third layer of foam 166 abuts the pocketed spring core 12.

Although the foam constructions or cushions 155, 170 of mattresses 10*n* and 10*o* shown in FIGS. 9 and 10, respectively, are shown used in a single-sided mattress, either foam construction or cushion 155, 170 may be used in any double-sided mattress or any mattress described or shown herein. Although the foam constructions or cushions 155, 170 of mattresses 10*n* and 10*o* shown in FIGS. 9 and 10, respectively, are shown with the rounded peaks and rounded valleys extending from side-to-side they may extend from head-to-foot or end-to-end.

Figure 11:
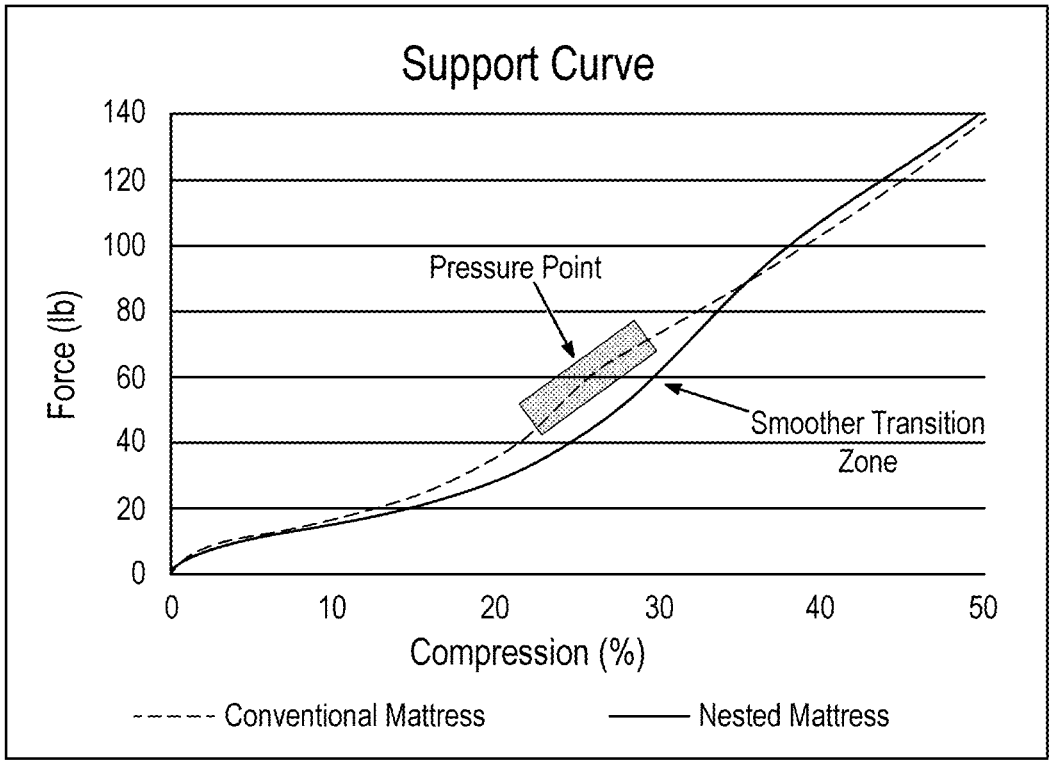
FIG. 11 is a graph showing a comparison of a mattress having a nested cushion in accordance with the present invention and a conventional mattress.

As shown in FIG. 11, mattresses constructed with nested convoluted foam layers create unique performance benefits than enhance sleep comfort. The overlap region of convolutions creates a continuously variable transition zone providing dramatically smoother support properties as the mattress is compressed under the body. The nested convolutions create an area of transition created by the convolutions. Smoother layer transitions create more uniform contouring and support properties, reduce pressure points and remove the sensation of "bottoming out" in the mattress.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A bedding or seating product having a longitudinal dimension, the linear distance between opposed end surfaces of the product, and a transverse dimension, the linear distance between opposed side surfaces of the product, the bedding or searing product comprising:

a pocketed spring core;

a first piece of foam having a flat surface proximate the pocketed spring core and rounded peaks and rounded valleys on the opposite side from the flat surface, each of the rounded peaks and rounded valleys of the first piece of foam extending in a transverse direction and having a zig-zag shape; and a second piece of foam having rounded peaks and rounded valleys nested with the rounded peaks and rounded valleys of the first piece of foam, each of the rounded peaks and rounded valleys of the second piece of foam extending in the transverse direction and having a zig-zag shape.

2. The product of claim 1, wherein at least one of the first and second pieces of foam contains phase change materials.

3. The product of claim 1, wherein at least one of the first and second pieces of foam contains at least one of the following additives: phase change materials, plant-based fibers, synthetic fibers, fragrances, slow-release fragrances, organic and inorganic antimicrobial additives, color additives, thermochromic materials, conductive additive solids, powders, particles, flakes, density reducing agents or gas generating materials.

4. The product of claim 1, wherein one of the first and second pieces of foam has a different firmness than other of the first and second pieces of foam.

5. The product of claim 1, wherein the first and second pieces of foam are made of different foams.

6. The product of claim 1, wherein at least one of the first and second pieces of foam contains conductive additive solids, powders, particles or flakes.

7. The product of claim 1, wherein the rounded peaks and rounded valleys of at least one of the first and second pieces of foam have different heights.

8. A bedding or seating product having a longitudinal dimension, the linear distance between opposed end surfaces of the product, and a transverse dimension, the linear distance between opposed side surfaces of the product, the bedding or searing product comprising:

a spring core;

a first piece of foam having a flat surface proximate the spring core and rounded peaks and rounded valleys on the opposite side from the flat surface, each of the rounded peaks and rounded valleys extending in a transverse direction and having in a wave shape along its length; and a second piece of foam having rounded peaks and rounded valleys in a wave shape nested with the rounded peaks and rounded valleys of the first piece of foam.

9. The product of claim 8, wherein the first and second pieces of foam are made of different foams.

10. The product of claim 8, wherein one of the first and second pieces of foam has a different firmness than other of the first and second pieces of foam.

11. The product of claim 8, wherein at least one of the first and second pieces of foam contains conductive additive solids, powders, particles or flakes.

12. The product of claim 8, wherein at least one of the first and second pieces of foam contains at least one of the following additives: phase change materials, plant-based fibers, synthetic fibers, fragrances, slow-release fragrances, organic and inorganic antimicrobial additives, color additives, thermochromic materials, conductive additive solids, powders, particles, flakes, density reducing agents or gas generating materials.

13. The product of claim 8, wherein the rounded peaks and rounded valleys of one of the first and second pieces of foam are of a first height and the rounded peaks and rounded valleys of one of the other of the first and second pieces of foam are of a second height different than the first height.

14. The product of claim 8, wherein the rounded peaks and rounded valleys of the first and second pieces of foam are identical in cross-section.

15. A bedding or seating product having a longitudinal dimension, the linear distance between opposed end surfaces of the product, and a transverse dimension, the linear distance between opposed side surfaces of the product, the bedding or searing product comprising:

a spring core;

a first piece of foam having a flat surface proximate the spring core and rounded peaks and rounded valleys on the opposite side from the flat surface, each of the rounded peaks and rounded valleys extending in a longitudinal direction and having in a wave shape along its length; and a second piece of foam having rounded peaks and rounded valleys nested with the rounded peaks and rounded valleys of the first piece of foam.

16. The product of claim 15, wherein at least one of the first and second pieces of foam contains at least one of the following additives: phase change materials, plant-based fibers, synthetic fibers, fragrances, slow-release fragrances, organic and inorganic antimicrobial additives, color additives, thermochromic materials, density reducing agents or gas generating materials.

17. The product of claim 15, wherein one of the first and second pieces of foam has a different firmness than other of the first and second pieces of foam.

18. The product of claim 15, wherein the first and second pieces of foam are made of different foams.

19. The product of claim 15, wherein at least one of the first and second pieces of foam contains phase change materials.

20. The product of claim 15, wherein the rounded peaks and rounded valleys of the first piece of foam have a height different than the rounded peaks and rounded valleys of the second piece of foam.

21. A bedding or seating product having a longitudinal dimension, the linear distance between opposed end surfaces of the product, and a transverse dimension, the linear distance between opposed side surfaces of the product, the bedding or searing product comprising:

a spring core;

a first piece of foam having a flat surface proximate the spring core and rounded peaks and rounded valleys on the opposite side from the flat surface, each of the rounded peaks and rounded valleys extending in a longitudinal direction and having a zig-zag shape along its length; and a second piece of foam having rounded peaks and rounded valleys nested with the rounded peaks and rounded valleys of the first piece of foam.

22. The product of claim 21, wherein at least one of the first and second pieces of foam contains at least one of the following additives: phase change materials, plant-based fibers, synthetic fibers, fragrances, slow-release fragrances, organic and inorganic antimicrobial additives, color additives, thermochromic materials, density reducing agents or gas generating materials.

23. The product of claim 21, wherein one of the first and second pieces of foam has a different firmness than other of the first and second pieces of foam.

24. The product of claim 21, wherein the first and second pieces of foam are made of different foams.

* * * * *